US007438784B2

(12) United States Patent
Kirveskari

(10) Patent No.: US 7,438,784 B2
(45) Date of Patent: Oct. 21, 2008

(54) METHOD AND APPARATUS FOR CALENDERING A PAPER OR PAPERBOARD WEB

(75) Inventor: Erkki Kirveskari, Halkia (FI)

(73) Assignee: Metso Paper, Inc., Helsinki (FI)

( * ) Notice: Subject to any disclaimer, the term of this patent is extended or adjusted under 35 U.S.C. 154(b) by 408 days.

(21) Appl. No.: 10/561,030

(22) PCT Filed: Jun. 17, 2004

(86) PCT No.: PCT/FI2004/050097

§ 371 (c)(1),
(2), (4) Date: Feb. 22, 2006

(87) PCT Pub. No.: WO2004/111335

PCT Pub. Date: Dec. 23, 2004

(65) Prior Publication Data

US 2006/0144544 A1 Jul. 6, 2006

(30) Foreign Application Priority Data

Jun. 18, 2003 (FI) ..... 20030913

(51) Int. Cl.
*D21G 1/00* (2006.01)

(52) U.S. Cl. ..... 162/122; 162/205; 162/283; 162/361

(58) Field of Classification Search ..... 162/118–122, 162/193, 204, 206, 255, 270, 271, 283, 361; 100/40, 76, 155 R, 160; 492/20; 242/533, 242/547, 222, 917; 264/175; 428/192
See application file for complete search history.

(56) References Cited

U.S. PATENT DOCUMENTS

| | | | | | |
|---|---|---|---|---|---|
| 4,087,319 | A * | 5/1978 | Linkletter | 162/113 |
| 4,179,330 | A * | 12/1979 | Page | 162/113 |
| 4,718,616 | A * | 1/1988 | Schmid et al. | 242/548 |
| 4,982,334 | A * | 1/1991 | Balakrishnan | 700/129 |
| 6,024,838 | A * | 2/2000 | Van Haag et al. | 162/361 |
| 6,158,333 | A * | 12/2000 | Honkalampi et al. | 100/38 |
| 6,189,442 | B1 | 2/2001 | Honkalampi et al. | |
| 6,536,704 | B1 * | 3/2003 | Rautakorpi et al. | 242/534 |
| 6,743,334 | B2 * | 6/2004 | Klerelid et al. | 162/118 |
| 6,755,940 | B2 * | 6/2004 | Lin et al. | 162/205 |
| 2002/0060036 | A1 * | 5/2002 | Linden | 162/283 |

FOREIGN PATENT DOCUMENTS

| | | | |
|---|---|---|---|
| DE | 44 37 533 | A1 | 4/1996 |
| GB | 2100768 | * | 1/1983 |
| GB | 2 218 434 | A | 11/1989 |
| WO | WO 2004/111335 | A1 | 12/2004 |

OTHER PUBLICATIONS

International Search Report issued in PCT/FI2004/050097.
International Preliminary Examination Report issued in PCT/FI2004/050097.

* cited by examiner

*Primary Examiner*—Eric Hug
(74) *Attorney, Agent, or Firm*—Stiennon & Stiennon

(57) ABSTRACT

A method and a device for calendering a paper or paperboard web, in which the web is led first into a calendering step and then into a reeling step. At least one edge area of the web is calendered separately in the reeling step.

21 Claims, 4 Drawing Sheets

METHOD AND APPARATUS FOR CALENDERING A PAPER OR PAPERBOARD WEB

CROSS REFERENCES TO RELATED APPLICATIONS

This application is a national stage application of International App. No. PCT/FI2004/050097, filed Jun. 17, 2004, the disclosure of which is incorporated by reference herein, and claims priority on Finnish App. No. 20030913, filed Jun. 18, 2003.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method for calendering a paper or paperboard web and to a device for implementing the aforementioned method.

In connection with papermaking, after the drying of the paper web, the web is subjected to calendering as a normal finishing step. There are many calendering methods, but it is common to all of them that the web is led through one or more nips formed between two surfaces, typically between rotating roll surfaces. The purpose of the calendering is to improve the quality of the paper by pressing it to a particular standard final thickness by affecting the density of the paper and by smoothening its surface, to achieve a desired paper gloss and/or smoothness. In other words, the calendering affects both the visual and the structural properties of paper.

The calendering roll can be a hard-faced heated thermo roll, a soft-faced variable-crown roll, a soft polymer roll, or a soft long-nip roll. Typically, one roll in a calendering nip is a hard-faced thermo roll and the other roll is one of the above-mentioned soft rolls. In multinip calenders, the rolls forming a nip may also be two soft-faced rolls.

Variable-crown rolls and polymer rolls are coated with a soft polymer coating which is normally made of an epoxy with a poor thermal stability. Consequently, in a nip in which one roll is a heated thermo roll and the other one is a roll coated with a soft coating, one must take care that the coating of the coated roll does not touch the thermo roll, which could result in a damage of the coating. A damaged roll must be replaced with a new one, which causes a break in the operation of the calender and increases the maintenance costs of the device.

At present, the coating of coated rolls is protected from the contact with the thermo roll e.g. by setting the width of the paper web precisely according to the width of the coated roll as well as by bevelling the edge areas of soft coatings to prevent the coating from touching the thermo roll outside the paper web. It is also known to calender the web in excess width, wherein the width of the web exceeds the length of the coated roll in the axial direction, wherein the outer edges of the web remain outside the nip and are thus not calendered at all. These edge areas can either be cut off or they can be calendered separately in an edge calendering step. The cutting of the edges requires that space-consuming edge cutters are placed on both sides of the web width in the calender. Furthermore, the strips cut off from both edges of the web, which are conveyed to a pulper, increase the quantity of waste from the paper machine. The cutting of the edge areas of the web after the calendering is disclosed in GB 2218434.

Edge calendering is performed either before or after the actual calendering. In U.S. Pat. No. 6,189,442, before the calendering of the rest of the web width, the edge areas of the paper web are calendered in a nip with a separate counter roll extending in its length across the whole width of the web, and considerably shorter edge calendering rolls corresponding to the width of the edges of the web extending beyond the length of the actual soft-faced calendering roll, at each edge of the web. One problem in this arrangement is the fact that the roll arrangements required by the edge calendering consume space in the calendering device.

SUMMARY OF THE INVENTION

Consequently, the aim of the present invention is to provide a method for calendering a paper or paperboard web by which the above-mentioned problems can be avoided and the edge areas of the web can be easily calendered without a separate, space-consuming counter roll installed for edge calendering. It is also an aim of the invention to provide a device implementing the aforementioned method.

The invention is based on the idea that the outer edges of the paper or paperboard web, i.e. the edge areas, are calendered in the reeling step following the calendering step. At least one calendering nip is provided, preferably two calendering nips, one for each edge of the web. The calendering nips are formed by means of a reeling cylinder in a reel-up and two calendering rolls which are shorter than the width of the web. The web is led to the reeling cylinder in such a way that the uncalendered web areas of the web are passed through the calendering nips. In this way, the edge areas of the web can be easily calendered by utilizing the reeling cylinder already existing in the paper machine, wherein no separate, space-consuming counter roll will be needed for the edge calendering.

According to one embodiment of the invention, the calendering roll is a conical roll, wherein it is secured that the calendering roll and the reeling cylinder which form the calendering nip have the same surface speed.

In the following, the invention will be described in more detail with reference to the appended drawings.

DESCRIPTION OF THE PREFERRED EMBODIMENTS

In this application, the roll length refers to the length of the shell of the roll in question, in its axial direction. The web width refers to the width of the paper or paperboard web in its cross direction. Furthermore, in this application, the term paper or paperboard web refers to paper, paperboard and tissue paper webs.

Figure 1:
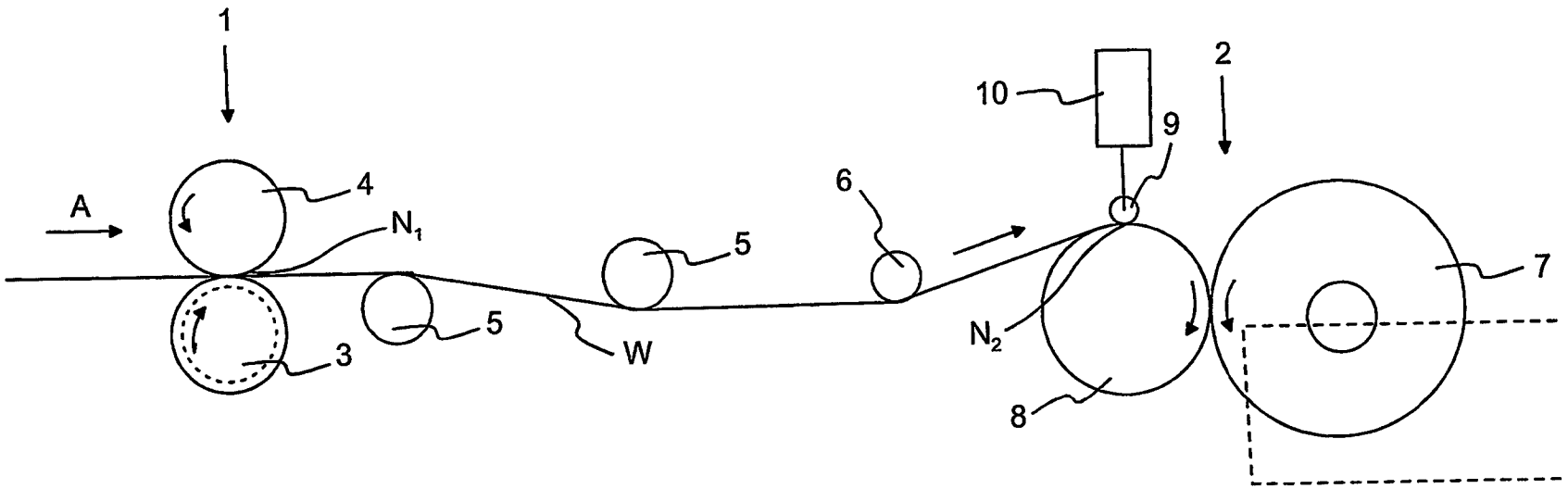
FIG. 1 shows, in a schematic side view, a device for calendering a paper or paperboard web according to the invention.
Figure 1A:
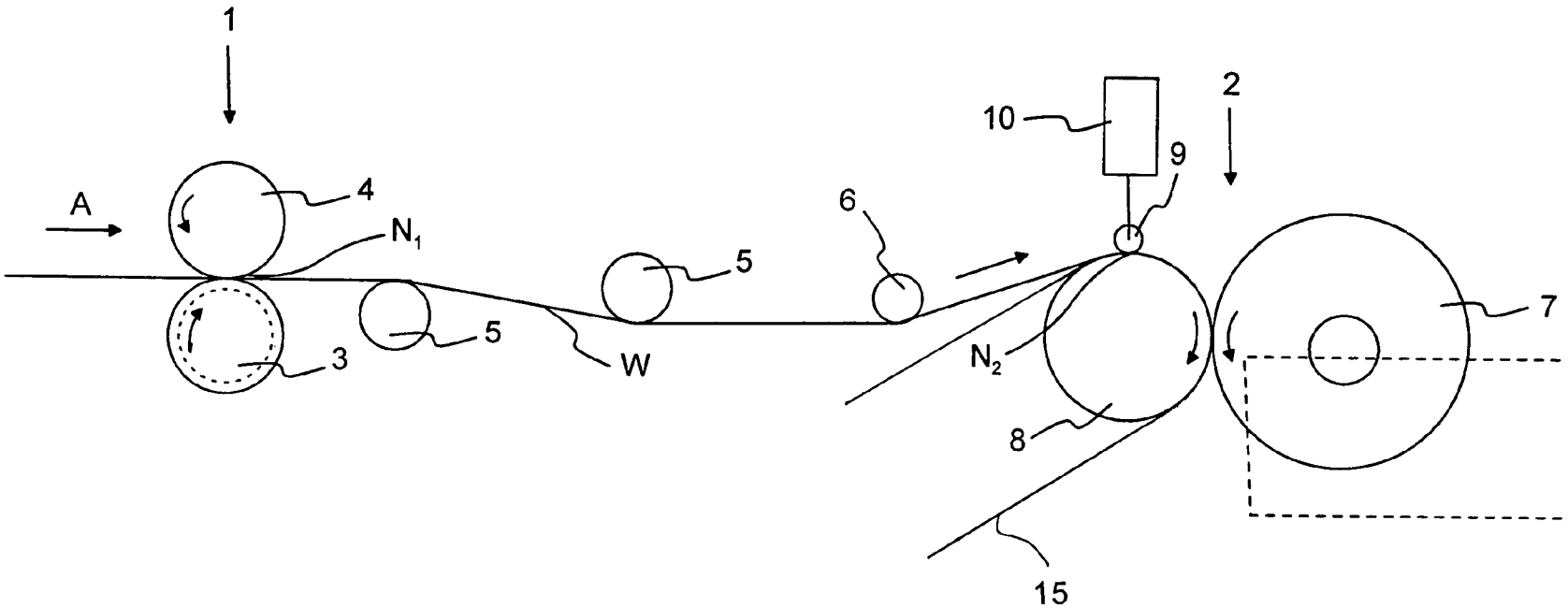
FIG. 1A shows, in a schematic side view, an alternative embodiment device for calendering a paper or paperboard web according to the invention.

FIG. 1 shows, in a schematic side view, a device for calendering a paper or paperboard web W. The web W is introduced in the calendering step 1 in the direction of an arrow A either directly from papermaking (so-called on-line calendering) or from an unwinder (so-called off-line calendering). The calendering step 1 comprises a nip $N_1$ formed by a soft coated roll 3 and a hard-faced heated roll 4, through which nip the web to be processed is introduced. Depending on the web to be calendered and its use, the calendering step may also comprise several calendering nips which may be formed of different rolls. It is essential that at least one nip is formed by means of a heated thermo roll and a soft-faced polymer roll.

The calendering of a paper or paperboard web, and the rolls involved therein, are known as such, and they will thus not be discussed in more detail. In the calendering step 1, the web is calendered in overwide form; that is, in the width direction, the web extends at its both edges over the axial length of the shell of the soft-faced polymer roll, but in such a way that the width of the web does not exceed the axial length of the shell of the heated thermo roll. Thus, both edges of the web, extending beyond the length of the polymer roll, remain uncalendered. If desired, thin strips can be cut off from the outer edges of the web to level out the edges of the web. The cutting of the edges can be performed either before or after the actual calendering. It is essential that even though a part of the outer edge of the web were cut off, an edge area remains which is intended to be reeled up but which has not been calendered in the nip between the actual calendering rolls because it has remained outside the nip width.

After the calendering step, the web is led by web guiding rolls 5 and a spreader roll 6 to the reeling step 2, in which the calendered web W is reeled up to form machine reels 7. The web is reeled by a means guiding the web onto a roll, such as a reeling cylinder 8 which is equipped with a center drive and which forms the reeling nip with the machine reel 7 being formed. The reeling of the paper or paperboard web, and the rolls and other equipment involved therein, are known as such and will thus not be discussed in more detail. Short calendering rolls 9 are pressed against the reeling cylinder 8 to form calendering nips $N_2$ and to calender separately the edge areas of the web which were left uncalendered in the calendering step 1. The calendering rolls are freely rotating and they are pressed against the reeling cylinder by means of actuators 10 which may be, for example, pneumatic or hydraulic actuators.

Figure 2:
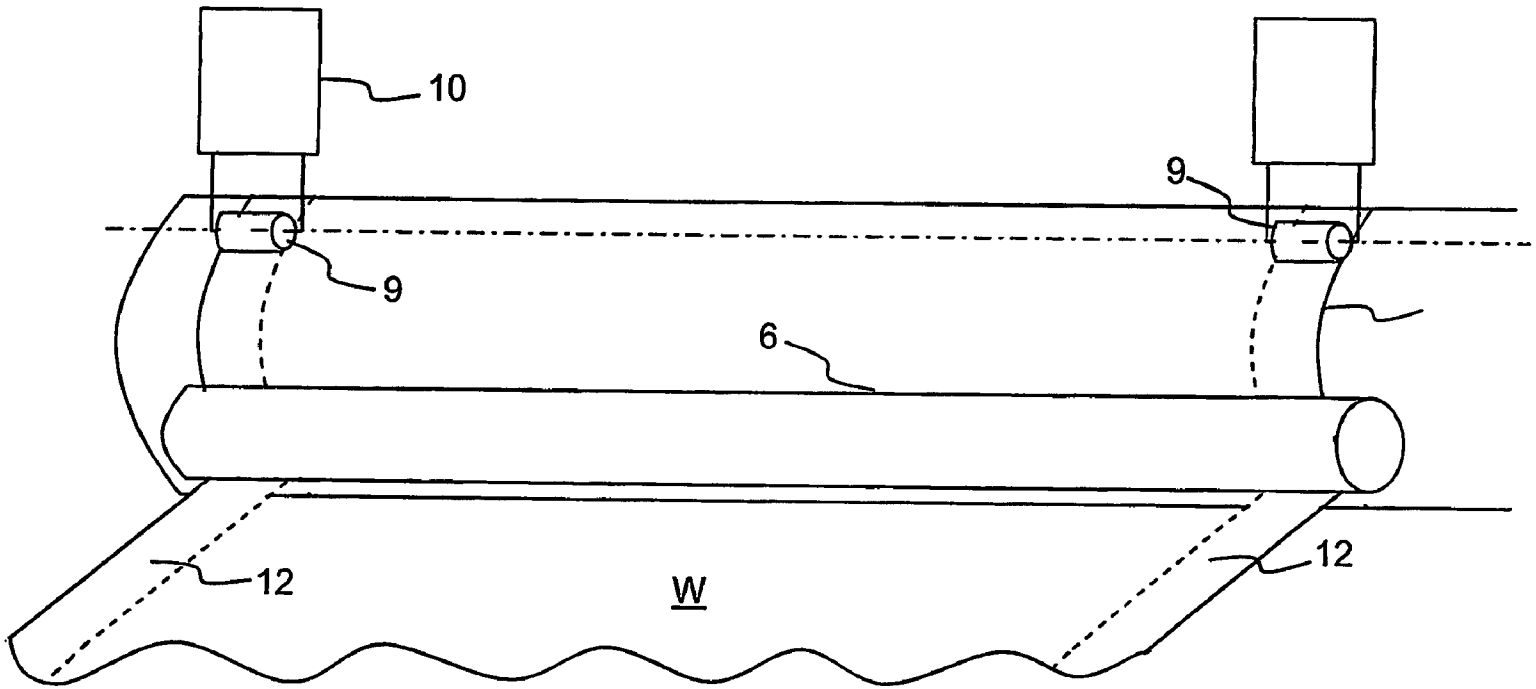
FIG. 2 shows, in a top view from the side, a device for calendering a paper or paperboard web according to the invention.

FIG. 2 shows, in a schematic side view, the device according to the invention for calendering the edge areas of a paper or paperboard web. By means of the reeling cylinder 8 and the calendering rolls 9, two calendering nips $N_2$ are formed, through which the edge areas 12 of the web W run. With respect to the web W, the calendering rolls 9 are placed in such a way that one end of the roll 9 extends at least to the edge 11 of the web W, and the other end is between the edge of the web W and the central line, at such a distance from the outer edge of the web that corresponds at least to the width of the edge area left uncalendered. The length of the shell of the calendering rolls in the axial direction of the rolls 9 depends on the axial length of the shell of the soft roll 3 used in the calendering step 1 and on the width of the web to be calendered. The total length of the calendering rolls 9 must be at least equal to the difference between the above-mentioned lengths, for processing those edge areas of the web which had been left uncalendered in the calendering step. The single calendering roll 9 is thus, in the axial direction, at least as long as the distance between one edge 11 and the area of influence of the pressing surface of the shell of the soft roll 3 (marked with a broken line in FIG. 2) at the edge in question. In other words, the length of the calendering roll 9 in its axial direction is at least equal to the width of said edge area 12 of the web; that is, the calendering roll extends over the whole edge area 12 of the uncalendered web. If desired, the calendering roll may be even longer and may extend, at its both ends, beyond the edge area 12 of the web W. The calendering rolls are preferably placed on the same line B intersecting the width of the web W in the transverse direction so that the surface of the shell of the reeling cylinder 8 supports the web before and after the calendering roll. The calendering rolls 9 rotate substantially at the same speed as the reeling cylinder 8, and they operate preferably simultaneously; that is, both edge areas 12 of the web are calendered simultaneously. The calendering rolls 9 may be either hard-faced steel rolls or soft polymer rolls, and their diameter is selected as desired. Generally, their diameter is substantially smaller than that of the rolls used in the calendering step 1, wherein their placement against the reeling cylinder is easier. In the embodiment of FIG. 2, the calendering rolls are conventional cylindrical rolls with substantially the same shell diameter from one end of the roll to the other.

It is also possible that the web W is calendered at the calendering step 1 so that only one edge of the web is provided with an uncalendered edge area; that is, the soft-faced polymer roll 3 is placed in alignment with the first outer edge of the web, and a part of the width of the web remains outside the nip width of the polymer roll, wherein one edge area of the web remains uncalendered. In this case, according to another embodiment of the invention, there is only one calendering roll 9 for the edge calendering in the reeling step 2, the roll being placed against the reeling cylinder 8 at one, uncalendered, edge of the web, to process the uncalendered edge area 12.

Figure 3:
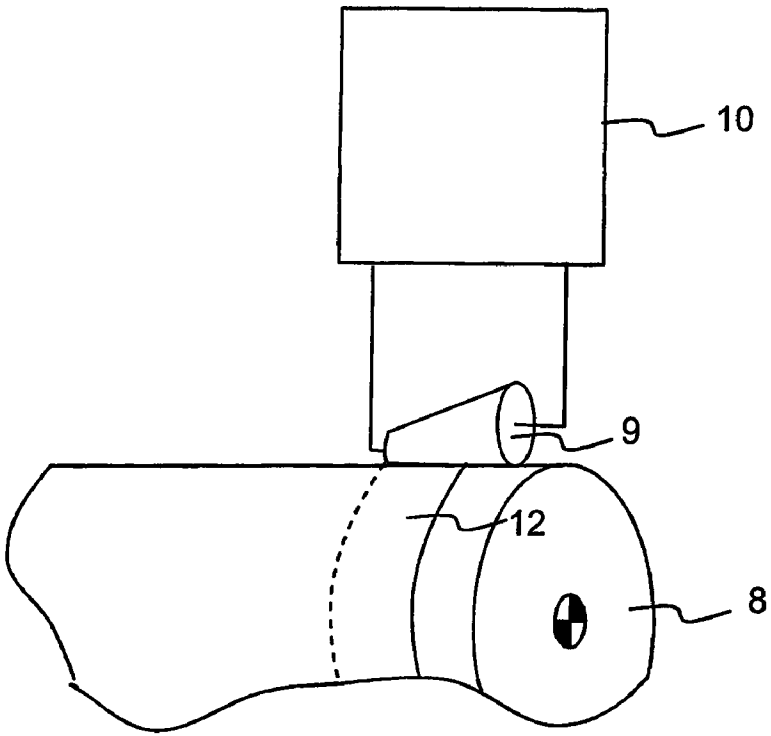
FIG. 3 shows, in a top view from the side, a calendering roll suitable for the device according to the invention.

FIG. 3 shows another calendering roll 9 suitable for the device according to the invention. The roll has a conical shape and it is pressed against the web so that the end of the roll with the larger diameter extends beyond the edge of the web and thus rests against the surface of the reeling cylinder 8. In this way, it is secured that the surface speeds of the calendering roll 9 and the reeling cylinder 8 are the same. The roll end with the smaller diameter extends at least beyond the width of the edge area 12 of the web to be calendered. The roll is pressed against the web by means of actuators coupled at the roll end having the smaller diameter.

The invention is not intended to be limited to the above embodiments presented as an example, but the invention is intended to be applied widely within the scope of the inventive idea as defined in the appended claims. For example, the calendering rolls 9 can be placed in different locations with respect to each other in the longitudinal direction of the web, wherein they are not on the same line intersecting the width of the web W in the transverse direction. Similarly, the means against which the short calendering rolls are placed in the reel-up may be another means guiding the web on its surface onto a reel and forming a reeling nip with the roll, for example a wire or belt loop. In this case, the calendering rolls 9 can be placed against the roll guiding the belt or wire loop 15.

The invention claimed is:

1. A method for calendering a paper or paperboard web, comprising the steps of:

calendering the web in a calender in a calendering step, followed by reeling the web in a reeling step; and wherein at least one edge area of the web is calendered in the reeling step separately from a remaining portion of the web.

2. The method according to claim 1, wherein the calendering of the edge areas of the web takes place in at least one calendering nip formed by a means guiding the web onto a roll, such as a reeling cylinder and a calendering roll.

3. The method according to claim 1, wherein two calendering nips are provided, one for each edge area of the web.

4. The method according to claim 3, wherein the calendering nips are placed on substantially the same straight line intersecting the width of the web in the transverse direction, and that the calendering of both edge areas of the web takes place substantially simultaneously at both edges of the web.

5. The method according to claim 1, wherein the length of the calendering roll in its axial direction is at least equal to the width of said edge area of the web.

6. A device for calendering a paper or paperboard web comprising:

a calender;

a reel-up; and means for calendering at least one edge area of the web separately from a remaining portion of the web in the reel-up.

7. The device according to claim 6, wherein the means for calendering the edge areas of the web comprise a means for guiding the web onto a roll, such as a reeling cylinder and at least one calendering roll, which form at least one calendering nip.

8. The device according to claim 6, wherein it comprises two calendering nips, one for each edge area of the web (W).

9. The device according to claim 8, wherein the calendering nips are placed on substantially the same straight line intersecting the width of the web in the transverse direction, and that both edge areas of the web are calendered substantially simultaneously.

10. The device according to claim 6, wherein the length of the calendering roll in its axial direction is at least equal to the width of the edge area of the web at said edge.

11. The device according to claim 6, wherein the shell of the calendering roll is substantially cylindrical.

12. The device according to claim 6, wherein the shell of the calendering roll is substantially conical.

13. A device for calendering a paper or paperboard web comprising:

a calender;

a reel-up positioned in web receiving relation with respect to the calender, a machine reel in the reel-up, wherein the reel-up has at least one roll forming a nip with the machine reel, the at least one roll arranged to guide the web on to the machine reel and the web extending over said at least one roll;

wherein the web extending over said at least one roll has portions forming a first web edge and portions forming a second web edge, the first web edge and the second web edge defining therebetween a web center line;

at least one edge calendering roll forming a nip with said at least one roll, through which the portion of the web forming the first web edge extends; and wherein the at least one edge calendering roll extends from a position between the web center line and the first edge to at least the first web edge.

14. The device of claim 13, further comprising a wire or belt loop arranged to guide the web to the web roll, and wherein the at least one roll guides the wire or belt loop to pass through the nip which the at least one roll forms with the web roll.

15. The device of claim 13 wherein the at least one roll forming a nip with the web roll is a reeling cylinder having a rotatable surface forming the nip with the web roll, and wherein the reeling cylinder is equipped with a center drive.

16. The device of claim 13 further comprising a second edge calendering roll which forms a nip with said at least one roll, through which the portion of the web forming the second web edge extends.

17. The device of claim 15 wherein the at least one edge calendering roll has a conical shape having an end with a larger diameter and an end with a smaller diameter, and wherein the least one edge calendering roll is pressed against the web on the reeling cylinder so that the end of the roll with the larger diameter extends beyond the first edge of the web and rests in driving relation against the rotatable surface of the reeling cylinder.

18. The device of claim 15 wherein the at least one edge calendering roll is mounted for free rotation and wherein an actuator is arranged to press the at least one edge calendering roll against the reeling cylinder.

19. The device of claim 13 wherein the calender has at least one nip formed between a hard-faced heated thermo roll and a soft-faced polymer roll.

20. The device of claim 16, wherein the first edge calendering roll and second edge calendering roll nips are placed on substantially a straight line perpendicular to the center line so that both the first web edge and the second web edge are calendered substantially simultaneously.

21. The device of claim 13, wherein the at least one edge calendering roll is substantially cylindrical.

* * * * *